US009138618B2

(12) United States Patent
Amano

(10) Patent No.: US 9,138,618 B2
(45) Date of Patent: Sep. 22, 2015

(54) GOLF CLUB

(71) Applicant: K. K. ENDO SEISAKUSHO, Tsubame-shi, Niigata (JP)

(72) Inventor: Junichi Amano, Tsubame (JP)

(73) Assignee: K. K. ENDO SEISAKUSHO, Tsubame-shi (JP)

( * ) Notice: Subject to any disclaimer, the term of this patent is extended or adjusted under 35 U.S.C. 154(b) by 126 days.

(21) Appl. No.: 14/041,955

(22) Filed: Oct. 1, 2013

(65) Prior Publication Data

US 2014/0094324 A1 Apr. 3, 2014

(30) Foreign Application Priority Data

Oct. 2, 2012 (JP) ..... 2012-220780

(51) Int. Cl.
*A63B 53/02* (2015.01)
*A63B 53/04* (2015.01)

(52) U.S. Cl.
CPC ..... *A63B 53/02* (2013.01); *A63B 53/047* (2013.01); *A63B 2053/0408* (2013.01)

(58) Field of Classification Search
CPC ..... A63B 53/02
USPC ..... 473/305, 315, 312
See application file for complete search history.

(56) References Cited

U.S. PATENT DOCUMENTS

| | | | | |
|---|---|---|---|---|
| 5,863,260 | A * | 1/1999 | Butler et al. | 473/305 |
| 5,910,056 | A * | 6/1999 | Nagamoto et al. | 473/305 |
| 2011/0003648 | A1 * | 1/2011 | Sanchez et al. | 473/305 |

FOREIGN PATENT DOCUMENTS

| | | | |
|---|---|---|---|
| JP | 09-108388 | A | 4/1997 |
| JP | 09-117536 | A | 5/1997 |
| JP | 11-104284 | A1 | 4/1999 |
| JP | 2005-52401 | A | 3/2005 |
| JP | 2005-520653 | A | 7/2005 |
| WO | 2003/080191 | A1 | 10/2003 |

* cited by examiner

*Primary Examiner* — Benjamin Layno
(74) *Attorney, Agent, or Firm* — Westerman, Hattori, Daniels & Adrian, LLP

(57) ABSTRACT

Three cylindrical concaves (reduced thickness portions) are formed in the intermediate portion between the centering so as to be spaced apart each other in the direction of the axis of the shaft inserting hole. The cylindrical concaves are formed to have an inner diameter of 11.3 mm that is larger than the inner diameter at the centering portions by removing the thickness of the hosel portion from its inner diameter of the centering portions towards outer side. The summed lengths of the bottom surfaces (peripheral surfaces) of the cylindrical concaves in the direction of the axis of the shaft inserting hole is 12 mm, thus reducing weight of the hosel portion by 3.03 g compared with conventional hosel portions. The reduced weight can be reallocated, to the sole portion. The gold thus produced in less expensive and has a reduced weight of the hosel.

6 Claims, 9 Drawing Sheets

FIG.4

| Golf Club | Reduced Weight (g) | XG (mm) | YG (mm) | ZG (mm) | HGR (mm) | HG (mm) | DG (mm) | G (mm) | Moment of Inertia (g·cm²) | |
|---|---|---|---|---|---|---|---|---|---|---|
| | | | | | | | | | Horizon -tal | Vertical |
| Cnventional Club | | 48. 4 | 19. 0 | 4. 0 | 19. 3 | 21. 0 | 35. 2 | 11. 6 | 2243 | 576 |
| First Embodiment | 3. 03 | 47. 7 | 18. 7 | 4. 3 | 18. 9 | 20. 7 | 35. 6 | 11. 8 | 2164 | 559 |
| Second Embodiment | 3. 70 | 47. 6 | 18. 6 | 4. 4 | 18. 8 | 20. 6 | 35. 7 | 11. 9 | 2146 | 555 |
| Third Embodiment | 3. 30 | 47. 7 | 18. 7 | 4. 4 | 18. 8 | 20. 7 | 35. 6 | 11. 9 | 2156 | 557 |

GOLF CLUB

FIELD OF THE INVENTION

The present invention relates to a golf club, and more particularly relates to a golf club with a reduced weight of the hosel portion to have a low center of gravity.

BACKGROUND OF THE INVENTION

The head of a golf club has a hosel portion to which one end of a shaft is secured. A grip for a player to grip is secured on the other end of the shaft and the hosel portion is formed to protrude upwards from the head. Consequently, the weight of the hosel portion causes the head to have a center of gravity of a high position. Making the center of gravity of the head lower, it becomes easier to hit a ball highly upwards as well as hit the ball at the position of center of gravity. Therefore, carried distance of a ball becomes long, which is advantageous especially for a golfer having a low head speed in club swing.

Various heads are proposed in which hosel portions are made to have a reduced weight in order to make heads have a low center of gravity. The heads disclosed in Japanese Patent Publication No. H09-108388, A1 (Patent Document 1) and Japanese Patent Publication No. H09-117536, A1 (Patent Document 2) is such that their hosel portions are formed of a material with a specific gravity less than that of the head. However, because the hosel portion and the head are formed of different materials in either of Patent Document 1 or Patent Document 2, they have such disadvantages that expense for producing the golf clubs increases, there is a fear of the hosel portion getting out of the head or it is difficult to connect the hosel portion with the head in a highly precise manner.

The head disclosed in Japanese Patent Publication No. 2005-52401, A1 (Patent Document 3) is composed without a hosel portion so that a hole having a form other than circular shape is formed in the head, a socket of a light weight material is fixed to the hole and the shaft is fixed to the socket. However, because the head of Patent Document 3 necessitates a socket of a member other than the head, it has such disadvantages that expense for producing the golf club increases and it is difficult to fix the socket to the hole of the head in a highly precise manner. Moreover, without a hosel portion, strange fearing occurs in time of addressing, thus making addressing less easy.

SUMMARY OF THE INVENTION

It is an object of the present invention to provide a golf club that has a hosel portion of reduced weight to have a lowered center of gravity and that can be produced easily with a low expense to have a precise dimension as well as a superior strength for enduring impact.

The aforementioned problems are solved by the following features of the present invention.

The golf club according to a first aspect of the present invention is a golf club comprising:

a head consisting of a sole portion having a surface for contacting with the ground on the lower side, a top portion on the upper side, a face portion having a surface for hitting a ball and a hosel portion for connecting with a shaft, and a shaft secured at one end to the shaft inserting hole formed in the hosel portion;

wherein the shaft inserting hole has:

centering portions for centering the shaft inserted into the shaft inserting hole, the centering portions being formed at the inlet portion and the bottom portion of the shaft inserting hole, a reduced thickness portion or a plurality of reduced thickness portions which is/are formed in the intermediate portion of the shaft inserting hole and in which the thickness of the hosel portion is removed from the inner diameter of the centering portion towards outer diameter side, and a guiding portion or a plurality of guiding portions which is/are formed in the intermediate portion of the shaft inserting hole and guides/guide the shaft inserted into the shaft inserting hole; and wherein the reduced thickness portion or plurality of reduced thickness portions and the guiding portion or guiding portions is/are disposed so that each element of the guiding portion is between two elements of the reduced thickness portion or each of the plurality of guiding portions is between two of the reduced thickness portions.

The golf club according to a second aspect of the invention is characterized in that, in the first aspect, the inner diameter of the centering portion formed at the bottom portion is identical with or smaller than the inner diameter formed at the inlet portion.

The golf club according to a third aspect of the invention is characterized in that, in the first aspect, the inner diameter of the guiding portions is identical with the inner diameter of the centering portion.

The golf club according to a fourth aspect of the invention is characterized in that, in any of the first to third aspects, the reduced thickness portions are a plurality of cylindrical concaves disposed to be spaced apart in the direction of the axis of the shaft inserting hole, and the guiding portions are a plurality of cylindrical convexes disposed to be spaced apart in the direction of the axis of the shaft inserting hole.

The golf club according to a fifth aspect of the invention is characterized in that, in the fourth aspect, the length of the shaft inserting hole along the axis is more than 20 mm, and the total length of the bottom surface of the cylindrical concaves along the axis of the shaft inserting hole is more than 10 mm.

The golf club according to a sixth aspect of the invention is characterized in that, in any of the first to the third aspects, the reduced thickness portion or portions is/are a spiral concave or spiral concaves around the axis of the shaft inserting hole, and the guide portion or portions is/are a spiral convex or spiral convexes around the axis of the shaft inserting hole.

The golf club according to a seventh aspect of the invention is characterized in that, in the sixth aspect, the bottom surfaces of the spiral concaves constitute a tapered face with the inner diameter of the inlet portion larger than that of the bottom portion.

The golf club according to a eighth aspect of the invention is characterized in that, in the sixth aspect, the spiral concave or concaves is/are a single thread of spiral concave or multi thread of spiral concaves.

The golf club according to a ninth aspect of the invention is characterized in that, in any of the first to the third aspects, the reduced thickness portions are a plurality of elongate concaves disposed in parallel to the axis of the shaft inserting hole to be spaced apart by an equal angle on the inner circumferential surface of the shaft inserting hole, and the guiding portions are a plurality of elongate convexes disposed in parallel to the axis of the shaft inserting hole to be spaced apart by an equal angle on the inner circumferential surface of the shaft inserting hole.

The golf club according to the present invention comprises a hosel portion formed integrally with the head and the hosel portion has centering portions formed at the inlet portion and the bottom portion of the shaft inserting hole formed in the hosel portion for centering a shaft inserted into the shaft inserting hole, a reduced thickness portion or reduced thickness portions which is/are formed in the intermediate portion of the shaft inserting hole and in which thickness of the hosel portion is removed from the inner diameter towards outer diameter side and a guiding portion or guiding portions which is/are formed in the intermediate portion of the shaft inserting hole and guides/guide the shaft inserted into the shaft inserting hole. Consequently, the hosel portion can be formed integrally with the head to make the head have a light weight, thus providing a golf club that can be produced easily with a lower expense, has a lowered center of gravity and a precise dimension as well as a superior strength for enduring impact.

BRIEF DESCRIPTION OF THE DRAWINGS

FIG. 4 is data showing results obtained by measuring heights of center of gravity of golf club heads according to embodiments of the present invention.

DETAILED DESCRIPTION OF PREFERRED EMBODIMENTS

[First Embodiment of Golf Club]

Figure 1B:
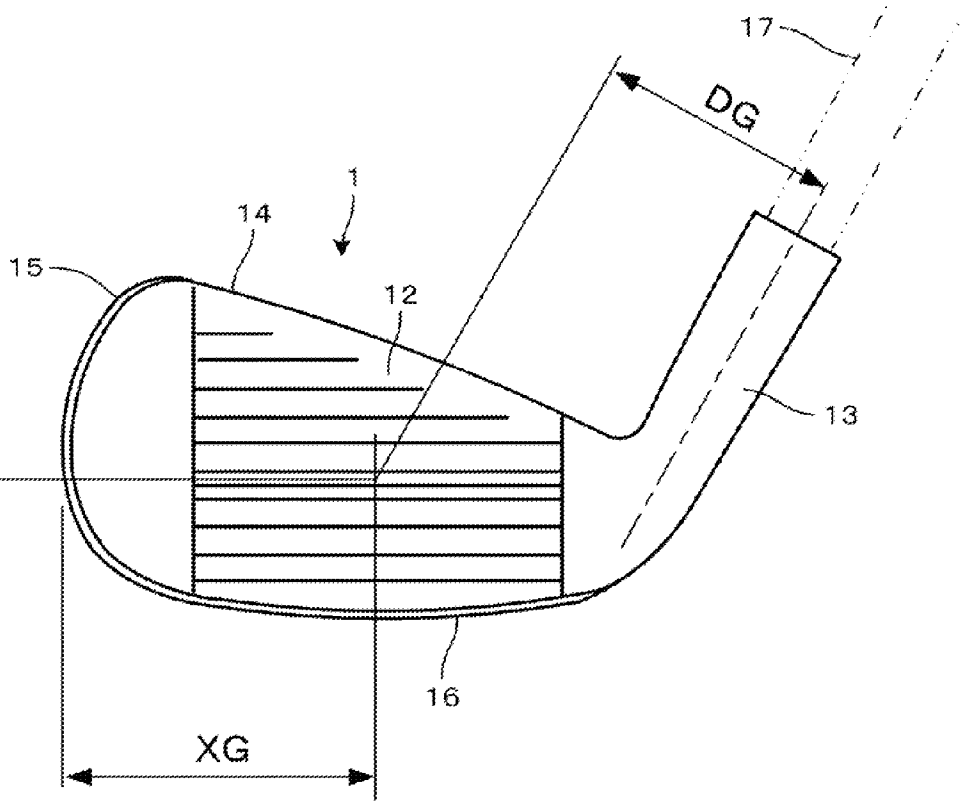
FIG. 1 is a view of a golf club head, in which (a) is a left side lateral view and (b) is a front view.
Figure 1A:
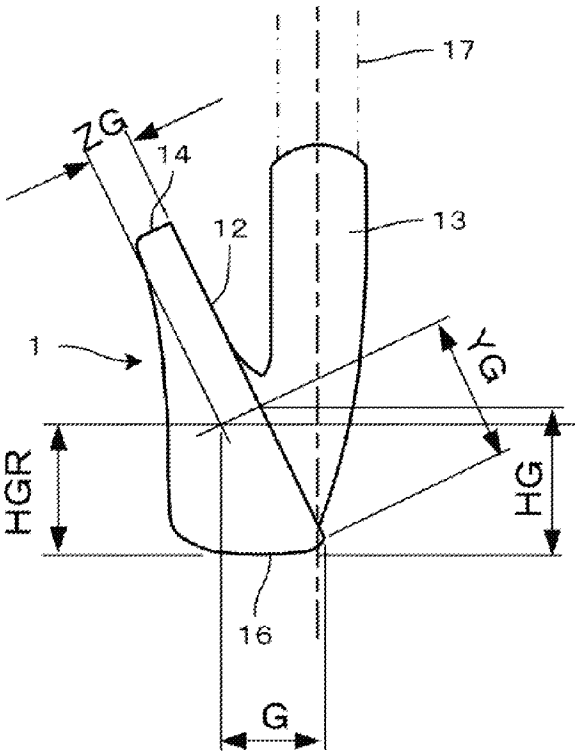

A first embodiment of the present invention will be explained below with reference to drawings. FIG. 1 is a view of a golf club head, in which (a) is a left side lateral view and (b) is a front view. The golf club shown in FIG. 1 is an example applied to an iron golf club, in which a head 1 has face portion 12 on the front side, a hosel portion 13 as a shaft fitting portion on the shaft side, a top portion 14 on the upper side, a toe portion 15 on the forward side and a sole portion on the side for contacting with the ground formed respectively. A shaft 17 is inserted into and secured to the hosel portion 13 of the head 1.

Figure 2:
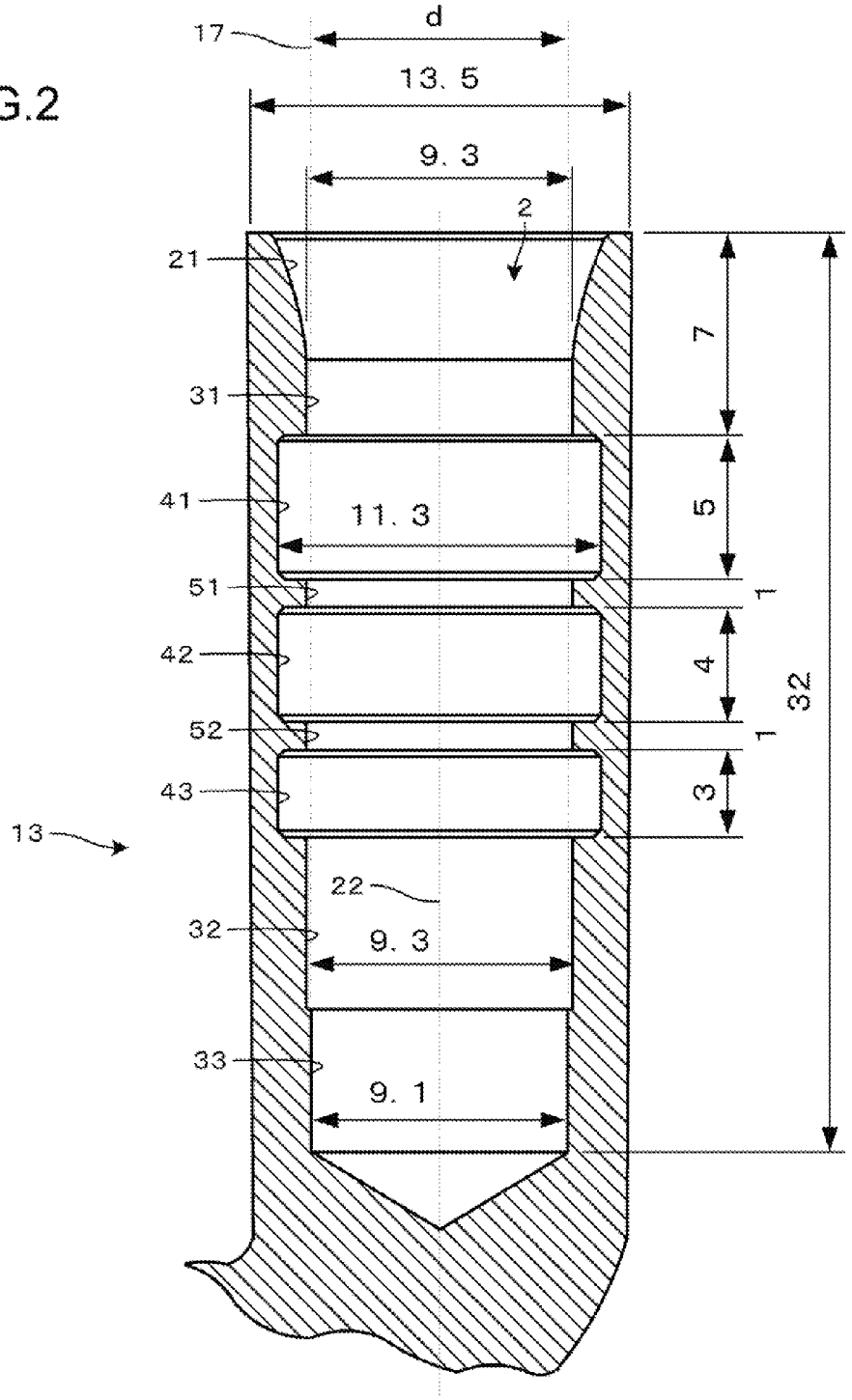
FIG. 2 is a lengthwise sectional view of the hosel portion of a golf club according to a first embodiment of the present invention.

FIG. 2 is a lengthwise sectional view of the hosel portion of a golf club according to a first embodiment of the present invention. The golf club according to the first embodiment is one applied to a shaft 17 in which its tip connected with the hosel portion 13 has a tapered shape (a tapered tip) with its crosswise dimension decreasing towards the end. As shown in FIG. 2, the hosel portion 13 is of a cylindrical shape with an outer diameter of 13.5 mm. The head is made of a material S20C and the hosel portion 13 is formed integrally with the head 1, that is, of the same material as the head 1. A shaft inserting hole 2, having a cross section of a circular form and a length of 32 mm in axial direction, is formed around the axis of the hosel portion 13. A chamfered portion 21 is formed on the inlet potion of the shaft inserting hole 2 (upper side in FIG. 2) and a centering portion 31 is formed below the chamfered portion 21. The chamfered portion 21 is formed so that it has an arc shape in a lengthwise cross section and its inner diameter decreases gradually from the inlet portion toward the centering portion 31 as well as the lower end of the chamfered portion 21 succeeds smoothly with the centering portion 31.

A centering portion 32 and a small diameter centering portion 33 are formed on the bottom of the shaft inserting hole 2 (lower side in FIG. 2). The inner diameter of the centering portions 31 and 32 is 9.3 mm, which is slightly larger than the outer diameter d of the large diameter portion at the tip of the shaft 17 (shown in FIG. 2). The inner diameter of the small diameter of the centering portion 33 is 9.1 mm, which is substantially identical with the outer diameter of the small diameter portion at the tip of the shaft 17 (lowermost side in FIG. 2). Three cylindrical concaves (reduced thickness portions) 41, 42, 43 are formed in the intermediate portion between the centering portions 31 and 32 so as to be spaced apart each other in the direction of the axis 22 of the shaft inserting hole 2. The cylindrical concaves 41, 42, 43 are formed to have an inner diameter of 11.3 mm that is larger than the inner diameter at the centering portions 31, 32 by removing the thickness of the hosel portion 13 towards the outer side. The lengths of the bottom surfaces (peripheral surfaces) of the cylindrical concaves 41, 42, 43 in the direction of the axis 22 of the shaft inserting hole 2 are 5 mm, 4 mm, 3 mm, respectively. The sum of the lengths amounts to 12 mm, thus reducing weight of the hosel portion by 3.03 g compared with conventional hosel portions (see FIG. 4). The reduced weight can be reallocated, for example, to the sole portion 16.

Two cylindrical convexes (guiding portions) 51, 52 are formed between the successive two of the cylindrical concaves 41, 42, 43, respectively, so as to be spaced apart in the direction of the axis 22 of the shaft inserting hole 2. The inner diameter of the cylindrical convexes 51, 52 is 9.3 mm, which is identical with the inner diameter of the centering portions 31, 32.

The cylindrical convexes 51, 52 serves to guide the shaft 17 smoothly through the shaft inserting hole 2 when the shaft is inserted, thus allowing smooth insertion of the shaft. Further, the cylindrical convexes 51, 52 have an advantageous effect to secure bending strength of the hosel portion 13 and also an advantageous effect to secure blank for adhesion of the shaft 17 to the shaft inserting hole 2. The small diameter centering portion 33 has an advantageous effect to align the shaft 17 precisely to the center of the shaft inserting hole 2 by fitting the small diameter portion at the tip end of the shaft 17 with its tapered shape tightly into the small diameter centering portion 33. In such a manner, when the shaft 17 with adhesive applied on it is inserted into the shaft inserting hole 2 and the shaft is fixed by causing it to adhere to the hosel portion 13 with adhesive, the shaft 17 can be fixed precisely to the hosel portion 13.

Figure 3:
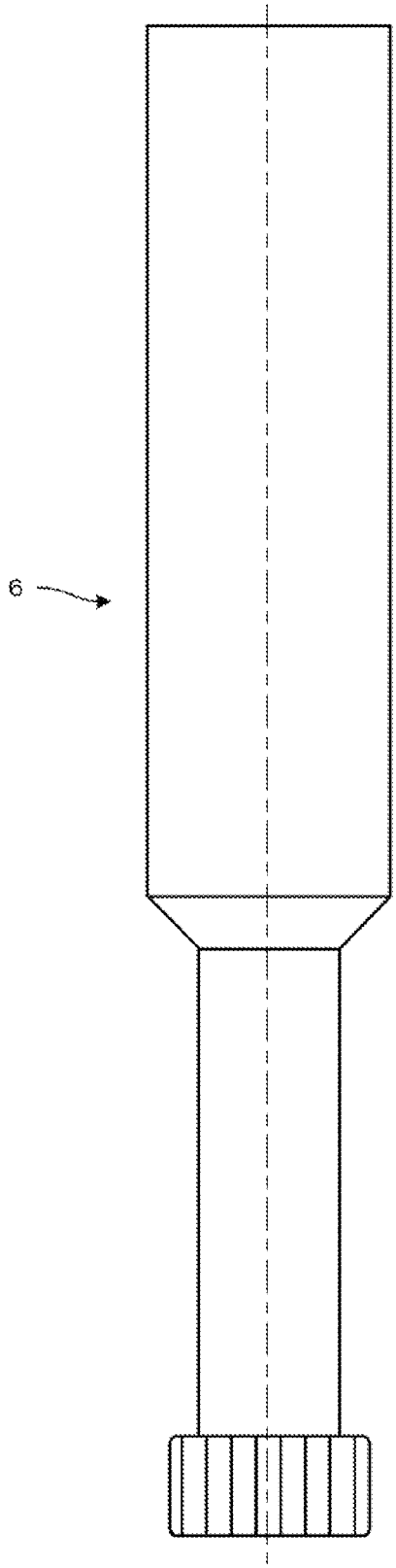
FIG. 3 is a front view of an end mill for machining the inner surface of the hosel portion.

Machining of the hosel portion 13 is performed as follows. First, while the head 1 is held by the chuck of a lathe (not shown), the outer periphery of the hosel portion 13 is machined with a periphery cutting tool and the centering portions 31, 32, 33 and the cylindrical convexes (guiding portions) 51, 52 are machined with a drill. After this, while the head 1 is fixed on the table of a vertical machining center (not shown), the cylindrical concaves (reduced thickness portions) 41, 42, 43 are machined with an end mill 6 shown in FIG. 3. Thus, efficient machining is performed.

FIG. 4 is data showing results obtained by measuring heights of center of gravity of golf club heads according to embodiments of the present invention. As shown in FIG. 4, the golf club according to the first embodiment allowed the weight to be less by 3.03 g than conventional iron golf clubs and also allowed the heights of center of gravity YG, HGR, HG to be lower by 0.3 mm, 0.4 mm, 0.3 mm respectively than conventional iron golf clubs. In order to confirm durability performance of the golf club according to the first embodiment, bending tests were performed with the head fixed by a fixing jig, in which the bending angle was changed 2 degrees into 4 degrees, then 4 degrees into 2 degrees. As a result, no anomalousness was found in each portion. Further, tests were performed in which balls were caused to collide with the face 2000 times at the center, 500 times at the toe and 500 times at the heel respectively with the ball speed of 42 m/s. As a result, no anomalousness was found in each portion.

The golf club according to the first embodiment has high precision of dimension, because the head and the hosel portion are formed integrally. With the golf club according to the first embodiment, strange fearing does not occur in time of addressing, thus making addressing easy, because its appearance of the hosel portion 13 is not changed from conventional. Further, with the golf club according to the first embodiment, the shaft inserting hole 2 of the hosel portion 13 has a circular shape of cross section symmetrical about the axis 22. Therefore, the angle of the shaft 17 relative to the head 1 can be adjusted easily.

[Second embodiment of Golf Club]

Figure 5:
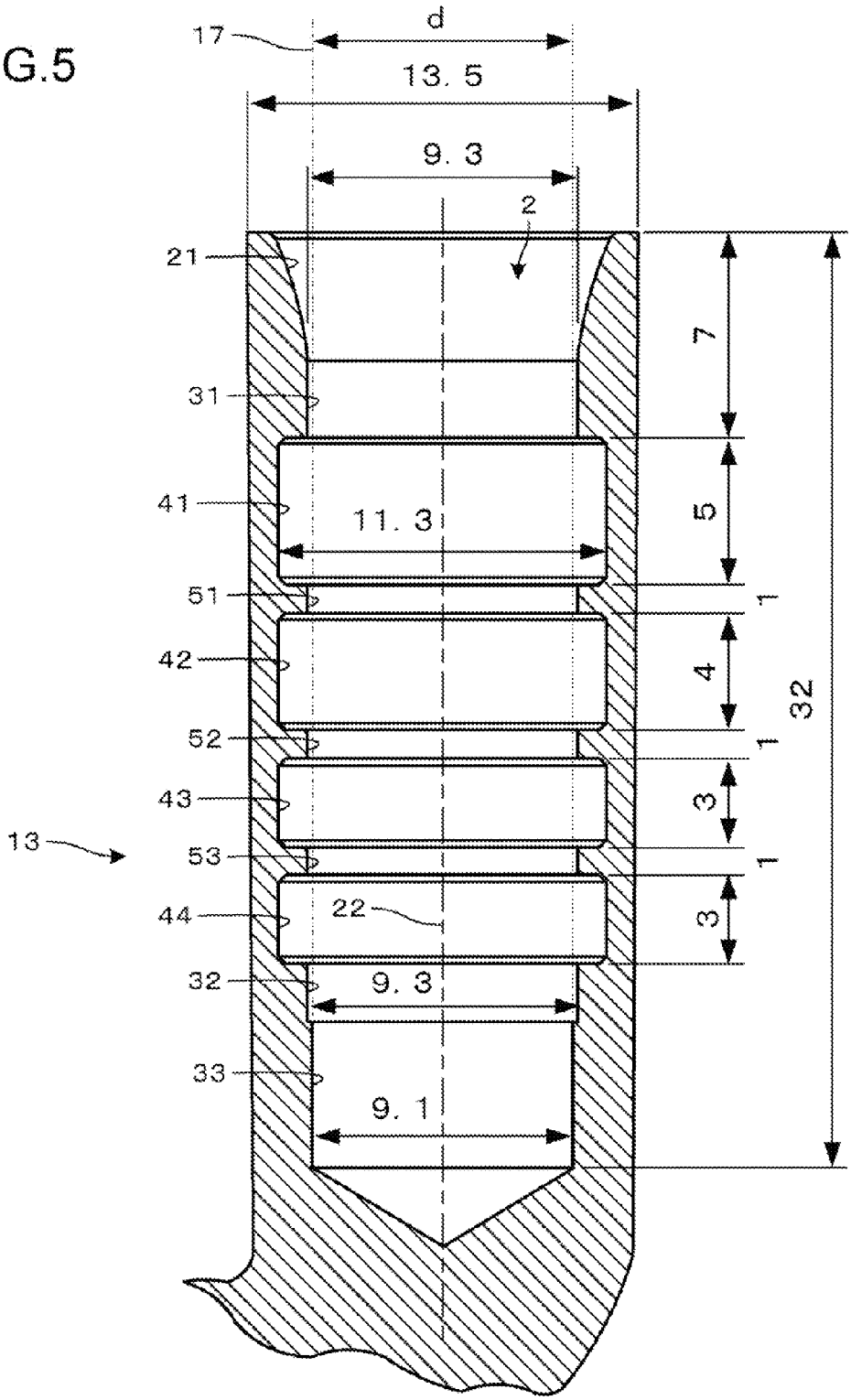
FIG. 5 is a lengthwise sectional view of the hosel portion of a golf club according to a second embodiment of the present invention.

FIG. 5 is a lengthwise sectional view of the hosel portion of a golf club according to a second embodiment of the present invention. The second embodiment is an modified example of a golf club according to the first embodiment, in which the number of the cylindrical concaves is increased to four to make the weight less than in the first embodiment. Explanation below remains to the structural parts different from the first embodiment, omitting the explanation of similar parts. The same reference numbers are denoted for the same parts.

As shown in FIG. 5, four cylindrical concaves (reduced thickness portions) 41, 42, 43, 44 are formed in the intermediate portion between the centering portions 31 and 32 so as to be spaced apart each other in the direction of the axis 22 of the shaft inserting hole 2. The cylindrical concaves 41, 42, 43, 44 are formed to have an inner diameter of 11.3 mm that is larger than the inner diameter at the centering portions 31, 32 by removing the thickness of the hosel portion towards the outer side. The lengths of the bottom surfaces (peripheral surfaces) of the cylindrical concaves 41, 42, 43, 44 in the direction of the axis 22 of the shaft inserting hole 2 are 5 mm, 4 mm, 3 mm, 3 mm respectively. The sum of the lengths amounts to 15 mm, thus reducing weight of the hosel portion by 3.70 g compared with conventional hosel portions (see FIG. 4).

Three cylindrical convexes (guiding portions) 51, 52, 53 are formed between the successive two of the cylindrical concaves 41, 42, 43, 44, respectively, so as to be spaced apart in the direction of the axis 22 of the shaft inserting hole 2. The inner diameter of the cylindrical convexes 51, 52, 53 is 9.3 mm, which is identical with the inner diameter of the centering portions 31, 32.

The cylindrical convexes 51, 52, 53 serves to guide the shaft 17 through the shaft inserting hole 2 when the shaft is inserted, thus allowing smooth insertion of the shaft. Further, the cylindrical convexes 51, 52, 53 have an advantageous effect to secure bending strength of the hosel portion 13 and also an advantageous effect to secure blank for adhesion of the shaft 17 to the shaft inserting hole 2. With the golf club according to the second embodiment, the weight of the hosel portion can be reduced by 3.70 g compared with conventional hosel portions and the heights of center of gravity YG, HGR, HG can be lowered by 0.4 mm, 0.5 mm, 0.4 mm respectively than conventional iron golf clubs.

[Third embodiment of Golf Club]

Figure 6:
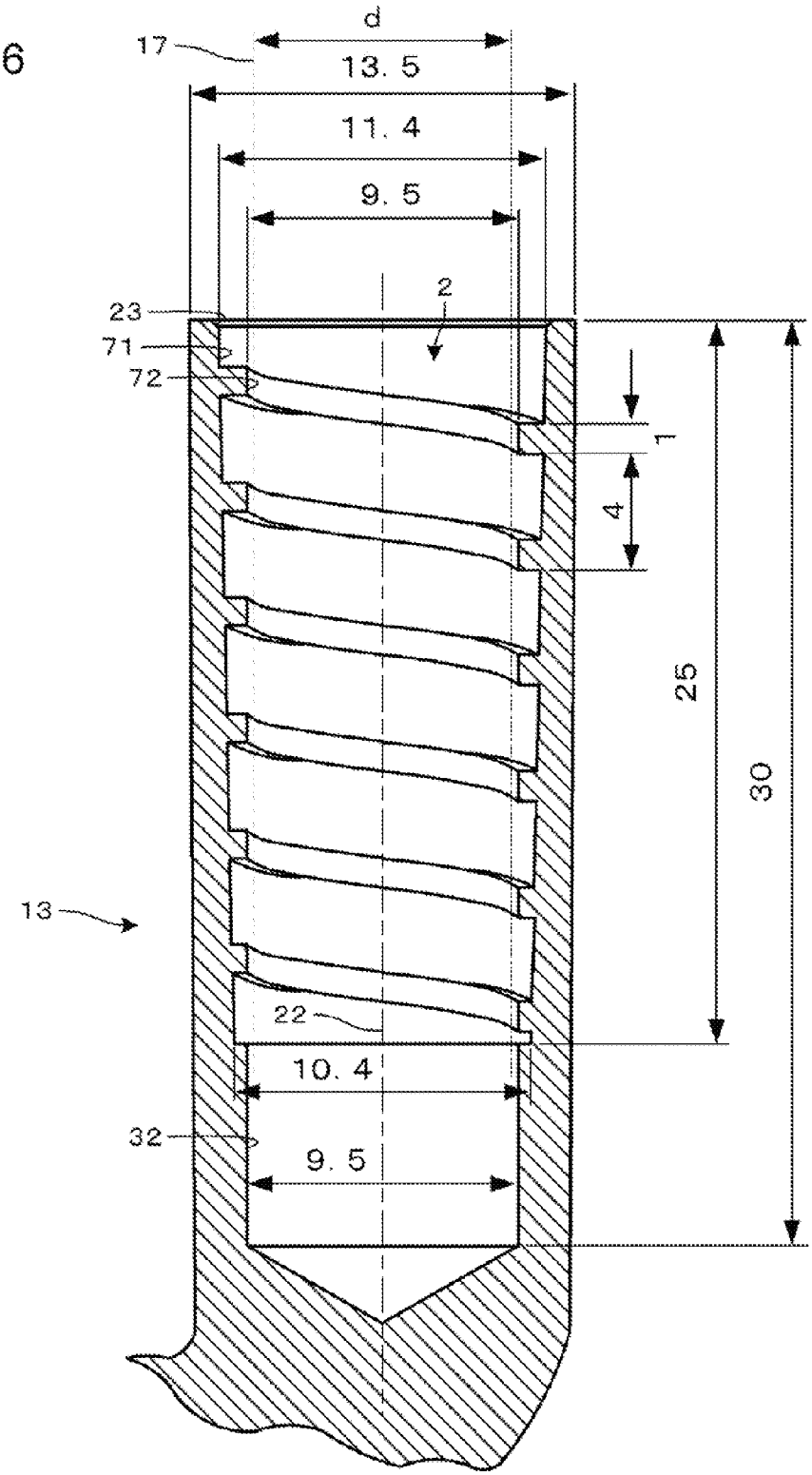
FIG. 6 is a lengthwise sectional view of the hosel portion of a golf club according to a third embodiment of the present invention.

FIG. 6 is a lengthwise sectional view of the hosel portion of a golf club according to a third embodiment of the present invention. The third embodiment is an example which is applied to a shaft 17 having a straight shape of the tip with a same diameter (a straight tip) connected to the hosel portion 13 and in which a reduced thickness portion and a guide portion are formed in a spiral shape respectively. Explanation below remains to the structural parts different from the first embodiment, omitting the explanation of similar parts. The same reference numbers are denoted for the same parts.

As shown in FIG. 6, a chamfered portion 23 with an inclination angle of 45 degrees is formed on the inlet portion (upper side in FIG. 6) of the shaft inserting hole 2. A thread of consecutive spiral concave (reduced thickness portion) 71 around the axis of the shaft inserting hole 2 is formed from beneath the chamfered portion 23 towards the bottom portion (underside in FIG. 6). A thread of consecutive spiral convex (guide portion) 72 is formed between the spiral concave 71 and to be paired therewith so as to be spaced apart in the direction of the axis 22 of the shaft inserting hole 2. Here, "between the spiral concave 72" means an arrangement in which each element of the spiral convex 71 is disposed between the upper and lower elements of the spiral concave 71. The inner diameter of the spiral convex 72 is 9.5 mm, which is slightly larger than the outer diameter d of the tip of the shaft 17. The outer diameter d is constant up to the tip end of the shaft 17. Consequently, the inlet portion of the spiral convex 72 (upper side in FIG. 6) serves as a centering portion to center the shaft 17 inserted into the shaft inserting hole 2. The spiral convex 72 is formed so as to have a width of 1 mm in the direction of the axis 22. The spiral concave 71 and spiral convex 72 have a pitch of 4 mm.

The spiral concave 71 is formed to have an inner diameter larger than the inner diameter of the spiral convex 72 by removing the thickness of the hosel portion 13 towards the outer side from the inner diameter of the spiral convex 72. The spiral concave 71 is formed to have a tapered surface with a diameter at the inlet portion (upper side in FIG. 6) of the shaft inserting hole 2 larger than the diameter at the bottom portion (lower side in FIG. 6), in which the diameter (inner diameter of the bottom surface) at the inlet portion of the spiral concave 71 is 11.4 mm and the diameter (inner diameter of the bottom surface) at the bottom portion is 10.4 mm. The spiral concave 71 is formed to have a length (span) of 25 mm in the direction of the axis 22 of the shaft inserting hole 2 from the inlet portion (upper side in FIG. 6) towards the bottom portion. With the golf club according to the third embodiment, weight is reduced by 3.30 g compared with conventional iron clubs (see FIG. 4).

A centering portion 32 is formed in the bottom of the shaft inserting hole 2 (lower side in FIG. 6). The inner diameter of the centering portion 32 is 9.5 mm, which is identical with the inner diameter of the spiral convex 72. The spiral convex 72 guides the shaft 17 smoothly when the shaft 17 is inserted into the shaft inserting hole 2, thus allowing a smooth insertion of the shaft. The spiral convex 72 have an advantageous effect to secure bending strength of the hosel portion 13 and also an advantageous effect to secure blank for adhesion of the shaft 17 to the shaft inserting hole 2. In such a manner, when the shaft 17 with adhesive applied on it is inserted into the shaft inserting hole 2 and the shaft is fixed by causing it to adhere to the hosel portion 13 with adhesive, the shaft 17 can be fixed precisely to the hosel portion 13.

Machining of the hosel portion 13 is performed as follows. First, while the head 1 is held by the chuck of a lathe (not shown), the outer periphery of the hosel portion 13 is machined with a periphery cutting tool and then the spiral convex 72 and the centering portion 32 are machined with a drill. After this, while the head 1 is fixed on the table of a vertical machining center (not shown), the spiral concave (reduced thickness portion) 71 is machined with an end mill 6 shown in FIG. 3. Thus, efficient machining is performed. As shown in FIG. 4, the golf club according to the third embodiment allowed the weight to be less by 3.30 g than conventional iron golf clubs and also allowed the heights of center of gravity YG, HGR, HG to be lower by 0.3 mm, 0.5 mm, 0.3 mm respectively than conventional iron golf clubs.

[Fourth Embodiment of Golf Club]

Figure 7:
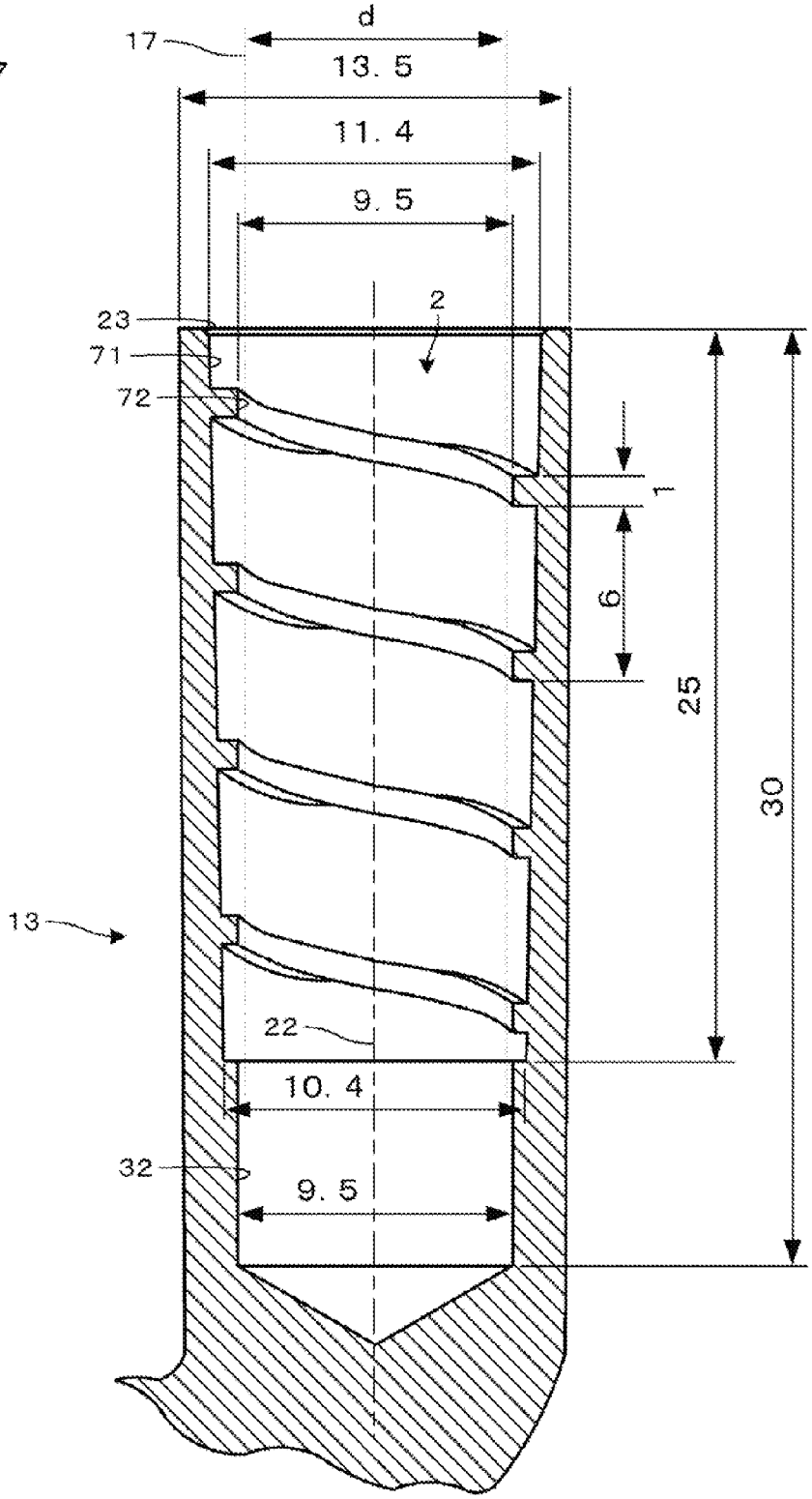
FIG. 7 is a lengthwise sectional view of the hosel portion of a golf club according to a forth embodiment of the present invention.

FIG. 7 is a lengthwise sectional view of the hosel portion of a golf club according to a forth embodiment of the present invention. The fourth embodiment is an modified example of the golf club according to the third embodiment, in which the pitch of a spiral concave 71 and a spiral convex 72 is made larger. Explanation below remains to the structural parts different from the third embodiment, omitting the explanation of similar parts. The same reference numbers are denoted for the same parts.

As shown in FIG. 7, a chamfered portion 23 with an inclination angle of 45 degrees is formed on the inlet portion (upper side in FIG. 7) of the shaft inserting hole 2. A thread of consecutive spiral concave (reduced thickness portion) 71 around the axis of the shaft inserting hole 2 is formed from beneath the chamfered portion 23 towards the bottom portion (underside in FIG. 7). A thread of consecutive spiral convex (guide portion) 72 is formed between the spiral concave 71 and to be paired therewith so as to be spaced apart in the direction of the axis 22 of the shaft inserting hole 2. Here, "between the spiral concave 72" means an arrangement in which each element of the spiral convex 71 is disposed between the upper and lower elements of the spiral concave 71. The inner diameter of the spiral convex 72 is 9.5 mm, which is slightly larger than the outer diameter d of the tip of the shaft 17. Consequently, the inlet portion of the spiral convex 72 (upper side in FIG. 6) serves as a centering portion to center the shaft 17 inserted into the shaft inserting hole 2. The spiral convex 72 is formed so as to have a width of 1 mm in the direction of the axis 22. The spiral concave 71 and spiral convex 72 have a pitch of 6 mm.

The spiral concave 71 is formed to have an inner diameter larger than the inner diameter of the spiral convex 72 by removing the thickness of the hosel portion 13 towards the outer side from the inner diameter of the spiral convex 72. The spiral concave 71 is formed to have a tapered surface with a diameter at the inlet portion (upper side in FIG. 7) of the shaft inserting hole 2 larger than the diameter at the bottom portion (lower side in FIG. 7), in which the diameter (inner diameter of the bottom surface) at the inlet portion of the spiral concave 71 is 11.4 mm and the diameter (inner diameter of the bottom surface) at the bottom portion is 10.4 mm. The spiral concave 71 is formed to have a length (span) of 25 mm in the direction of the axis 22 of the shaft inserting hole 2 from the inlet portion (upper side in FIG. 6) towards the bottom portion. With the golf club according to the third embodiment, weight is reduced by 3.69 g compared with conventional iron clubs. A centering portion 32 is formed in the bottom of shaft inserting hole 2 (lower side in FIG. 7). The inner diameter of the centering portion 32 is 9.5 mm, which is identical with the inner diameter of the spiral convex 72.

[Fifth Embodiment of Golf Club]

Figure 8:
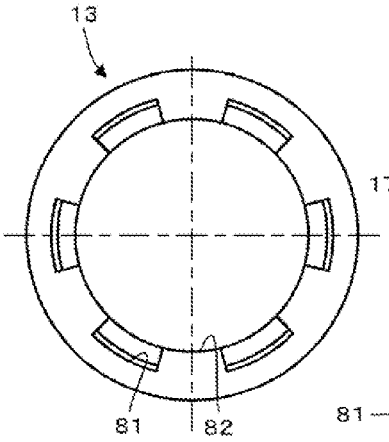
FIG. 8 is views of the hosel portion of a golf club according to a fifth embodiment of the present invention, in which (a) shows a plan view and (b) shows a lengthwise sectional view.
Figure 8:
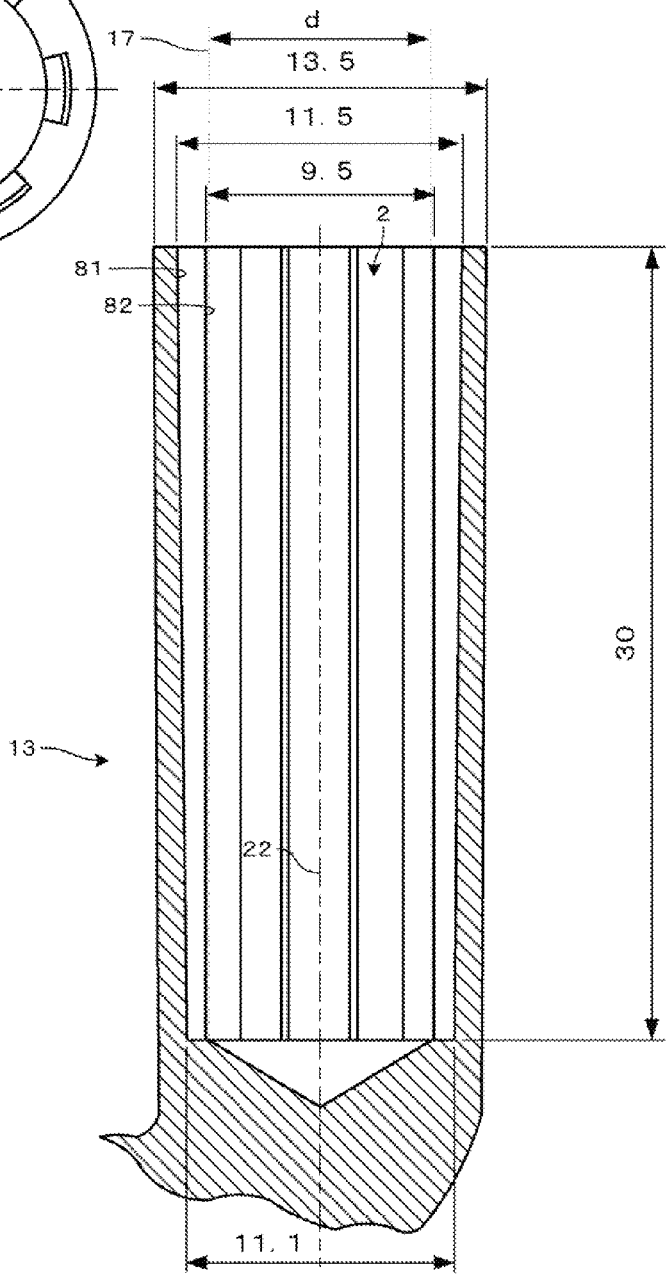

FIG. 8 is views of the hosel portion of a golf club according to a fifth embodiment of the present invention. The firth embodiment is an example which is applied to a shaft 17 having a straight shape of the tip with a same diameter (a straight tip) connected to the hosel portion 13 and in which reduced thickness portions and guide portions are disposed so as to be parallel to the axis of the shaft inserting hole and spaced apart by an equal angle relative to the center (axis) on the inner circumferential surface. Explanation below remains to the structural parts different from the first embodiment, omitting the explanation of similar parts. The same reference numbers are denoted for the same parts.

As shown in FIG. 8, six rectangular concaves (reduced thickness portions) 81 are disposed so as to be parallel to the axis 22 of the shaft inserting hole 2 from the inlet portion (upper side in FIG. 8(*b*)) of the shaft inserting hole 2 towards the bottom portion (lower side in FIG. 8(*b*)) of the shaft inserting hole 2 and spaced apart by an equal angle (60 degrees) relative to the center (axis) on the inner circumferential surface. Six rectangular convexes (guide portions) 82 are formed so that each of them is disposed between two of the rectangular concaves 81 in parallel to the axis 22 of the shaft inserting hole 2 and spaced apart by an equal angle (60 degrees) relative to the center (axis) on the inner circumferential surface. The inner diameter of the convexes 82 is 9.5 mm, which is slightly larger the outer diameter of d of the shaft 17. Consequently, the inlet portion (upper side in FIG. 8) of the convexes 82 serves as a centering portion for centering the shaft 17 inserted into the shaft inserting hole 2.

The concaves 81 are formed to have an inner diameter larger than the inner diameter of the convexes 82 by removing the thickness of the hosel portion 13 towards the outer side from the inner diameter of the convexes 82. The concaves 81 are formed to have a tapered surface with a diameter at the inlet portion (upper side in FIG. 8(*b*)) of the shaft inserting hole 2 larger than the diameter at the bottom portion (lower side in FIG. 8(*b*)), in which the inner diameter at the inlet portion of the concaves 81 is 11.5 mm and the inner diameter at the bottom portion of the concaves 81 is 11.1 mm. The concaves 81 are formed to have a length of 30 mm in the direction of the axis 22 from the inlet portion (upper side in FIG. 8(*b*)) of the shaft inserting hole 2 towards the bottom portion. With the golf club according to the fifth embodiment, weight is reduced by 3.38 g compared with conventional iron clubs (see FIG. 4).

The convexes 82 guide the shaft 17 smoothly when the shaft 17 is inserted into the shaft inserting hole 2, thus allowing a smooth insertion of the shaft. The convexes 82 have an advantageous effect to secure bending strength of the hosel portion 13 and also an advantageous effect to secure blank for adhesion of the shaft 17 to the shaft inserting hole 2.

Machining of the hosel portion 13 is performed as follows. First, while the head 1 is held by the chuck of a lathe (not shown), the outer periphery of the hosel portion 13 is machined with a periphery cutting tool and then the convexes 82 within the hosel portion are machined with a drill. After this, while the head 1 is fixed on the table of a broaching machine (not shown), the concaves (reduced thickness portion) 81 is machined with a broaching tool (not shown). Thus, efficient machining is performed.

[Sixth Embodiment of Golf Club]

Figure 9A:
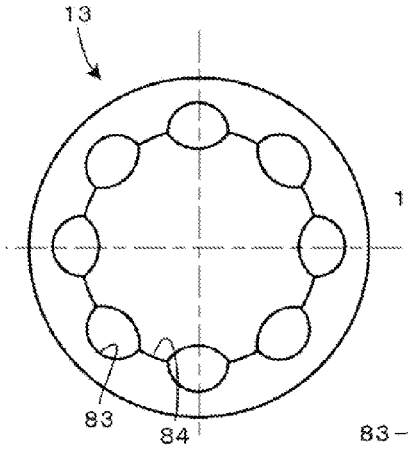
FIG. 9 is views of the hosel portion of a golf club according to a sixth embodiment of the present invention, in which (a) shows a plan view and (b) shows a lengthwise sectional view.
Figure 9B:
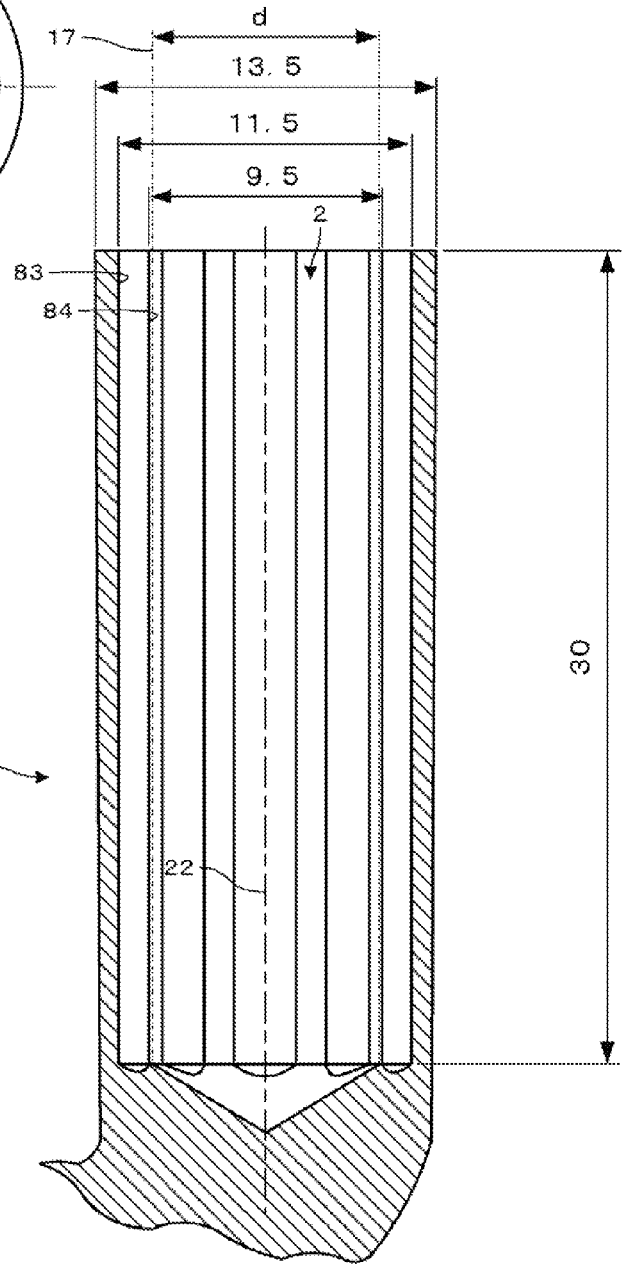

FIG. 9 is views of the hosel portion of a golf club according to a sixth embodiment of the present invention. The sixth embodiment is a modified example of the golf club according to the fifth embodiment, in which sectional configurations of the concaves and convexes are altered. Explanation below remains to the structural parts different from the first embodiment, omitting the explanation of similar parts. The same reference numbers are denoted for the same parts.

As shown in FIG. 9, eight arc-shaped concaves (reduced thickness portions) 83 are disposed so as to be parallel to the axis 22 of the shaft inserting hole 2 from the inlet portion (upper side in FIG. 9(*b*)) of the shaft inserting hole 2 towards the bottom portion (lower side in FIG. 9(*b*)) of the shaft inserting hole 2 and spaced apart by an equal angle (45 degrees) relative to the center (axis) on the inner circumferential surface. Eight arc-shaped convexes (guide portions) 84 are formed so that each of them is disposed between two of the arc-shaped concaves 83 in parallel to the axis 22 of the shaft inserting hole 2 and spaced apart by an equal angle (45 degrees) relative to the center (axis) on the inner circumferential surface. The inner diameter of the convexes 84 is 9.5 mm, which is slightly larger the outer diameter of d of the shaft 17. Consequently, the inlet portion (upper side in FIG. 9) of the convexes 84 serves as a centering portion for centering the shaft 17 inserted into the shaft inserting hole 2.

The concaves 83 are formed to have an inner diameter larger than the inner diameter of the convexes 84 by removing the thickness of the hosel portion 13 towards the outer side from the inner diameter of the convexes 84. The concaves 83 are formed so that inner diameter is of a same dimension from the inlet portion (upper side in FIG. 9(*b*)) of the shaft inserting hole 2 to the bottom portion (lower side in FIG. 9(*b*)), which is 11.5 mm. The concaves 83 are formed to have a length of 30 mm in the direction of the axis 22 from the inlet portion (upper side in FIG. 9(*b*)) of the shaft inserting hole 2 towards the bottom portion. With the golf club according to the sixth embodiment, weight is reduced by 3.76 g compared with conventional iron clubs.

While embodiments of the present invention have been explained above, the present invention is not restricted to these. It is not necessary to say that modification is possible without departing from the objects and gist of the present invention. For example, while the above mentioned embodiments are those applied to iron clubs, the present invention is not restricted to an iron club, but may be applied to a wood club. Further, while an example with a single thread spiral concave formed is explained above, the present invention is not restricted to a single thread spiral concave but multiple thread spiral concaves may be formed.

What is claimed is:

1. A golf club comprising:

a head consisting of a sole portion having a surface for contacting with the ground on the lower side, a top portion on the upper side, a face portion having a surface for hitting a ball and a hosel portion for connecting with a shaft, and a shaft secured at one end to the shaft inserting hole formed in the hosel portion;

wherein the shaft inserting hole has:

centering portions for centering the shaft inserted into the shaft inserting hole, the centering portions being formed at the inlet portion and the bottom portion of the shaft inserting hole, a plurality of reduced thickness portions which are formed in the intermediate portion of the shaft inserting hole and in which the thickness of the hosel portion is removed from the inner diameter of the centering portion towards outer diameter side, and a plurality of guiding portions which are formed in the intermediate portion of the shaft inserting hole and which guide the shaft inserted into the shaft inserting hole;

wherein the plurality of reduced thickness portions are a plurality of cylindrical concaves disposed to be spaced apart from each other in the direction of the axis of the shaft inserting hole, wherein the guiding portions are a plurality of cylindrical convexes disposed to be spaced apart from each other in the direction of the axis of the shaft inserting hole, wherein the length of the shaft inserting hole along the axis is more than 20 mm, and wherein the total length of the bottom surface of the cylindrical concaves along the axis of the shaft inserting hole is more than 10 mm.

2. A golf club according to claim 1, wherein the inner diameter of the centering portion formed at the bottom portion is identical with or smaller than the inner diameter formed at the inlet portion.

3. A golf club according to claim 1, wherein the inner diameter of the guiding portions is identical with the inner diameter of the centering portion.

4. A golf club, comprising:

a head consisting of a sole portion having a surface for a contacting with the ground on the lower side, a top portion on the upper side, a face portion having a surface for hitting a ball and a hosel portion for connecting with a shaft, and a shaft at one end to the shaft inserting hole formed in the hosel portion;

wherein the shaft inserting hole has:

centering portions for centering the shaft inserted into the shaft inserting hole, the centering portions being formed at the inlet portion and the bottom portion of the shaft inserting hole, a plurality of reduced thickness portions which are formed in the intermediate portion of the shaft inserting hole and in which the thickness of the hosel portion is removed from the inner diameter of the centering portion towards outer diameter side, and a plurality of guiding portion which are formed in the intermediate portion of the shaft inserting hole and which guide the shaft inserted into the shaft inserting hole;

wherein the reduced thickness portions are a plurality of elongate concaves disposed in parallel to the axis of the shaft inserting hole to be spaced apart by an equal angle on the inner circumferential surface of the shaft inserting hole, and wherein the guiding portions are a plurality of elongate convexes disposed in parallel to the axis of the shaft inserting hole to be spaced apart by an equal angle on the inner circumferential surface of the shaft inserting hole.

5. A golf club according to claim 4, wherein the inner diameter of the centering portion formed at the bottom portion is identical with or smaller than the inner diameter formed at the inlet portion.

6. A golf club according to claim 4, wherein the inner diameter of the guiding portions is identical with the inner diameter of the centering portion.

* * * * *